United States Patent [19]

Spaulding

[11] Patent Number: 4,633,558

[45] Date of Patent: Jan. 6, 1987

[54] CAM ACTION TOOL FOR APPLYING A SPRING CLAMP

[75] Inventor: George E. Spaulding, Woodridge, Ill.

[73] Assignee: Wittek Industries, Inc., Broadview, Ill.

[21] Appl. No.: 833,549

[22] Filed: Feb. 27, 1986

[51] Int. Cl.[4] ..... B25B 25/00

[52] U.S. Cl. ..... 29/229; 81/9.3; 81/308; 29/268

[58] Field of Search ..... 29/225, 229, 268; 81/9.3, 486, 303–310

[56] References Cited

U.S. PATENT DOCUMENTS

| | | | |
|---|---|---|---|
| 1,498,488 | 6/1924 | Stallings | 81/309 |
| 1,806,339 | 5/1931 | Ferris et al. | 81/310 X |
| 2,090,872 | 8/1937 | Lamb | 81/303 X |
| 2,747,446 | 5/1956 | Eder | 81/304 |
| 2,935,907 | 5/1960 | Murphy | 81/9.3 |
| 3,257,874 | 6/1966 | Madeira | 81/9.3 |

FOREIGN PATENT DOCUMENTS

| | | | |
|---|---|---|---|
| 608564 | 11/1960 | Canada | 29/268 |

*Primary Examiner*—Frederick R. Schmidt
*Assistant Examiner*—Steven P. Schad
*Attorney, Agent, or Firm*—Lyman R. Lyon

[57] ABSTRACT

A tool for applying a spring clamp comrising a pair of handles, a pin joining said handles for relative rotation, a pair of jaws on said handles, a cam carried by one of the jaws and a pair of side plates pivotally supported by the other of said jaws having cam control tracks therein for effecting and controlling radial movement of said cam to complete closure of said clamp.

4 Claims, 5 Drawing Figures

FIG. 1.
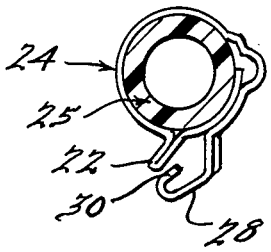
FIG. 2.
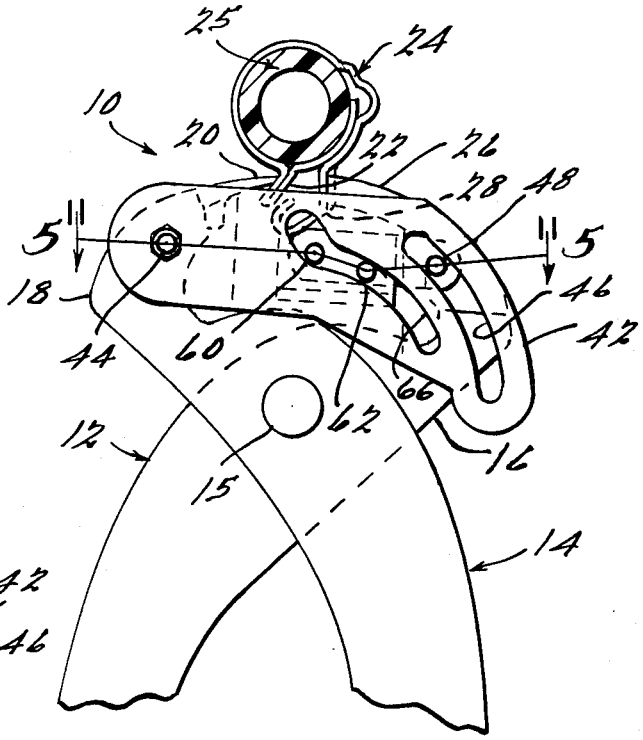
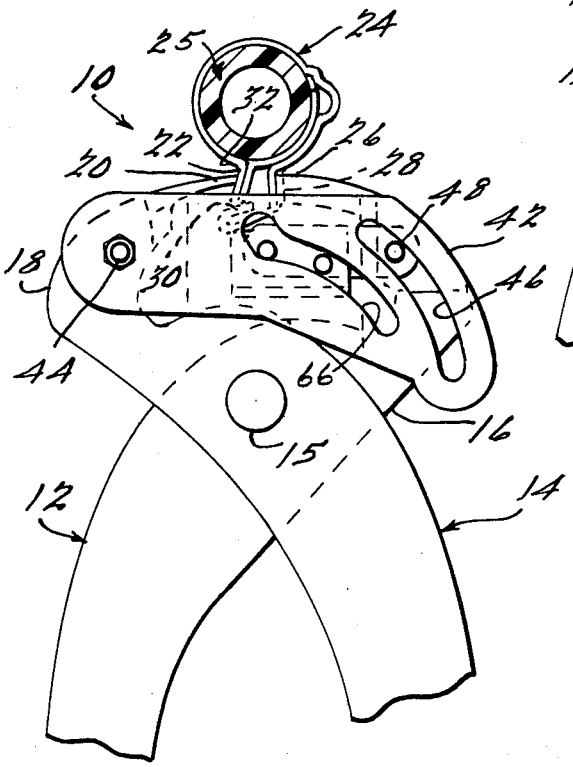
FIG. 3.
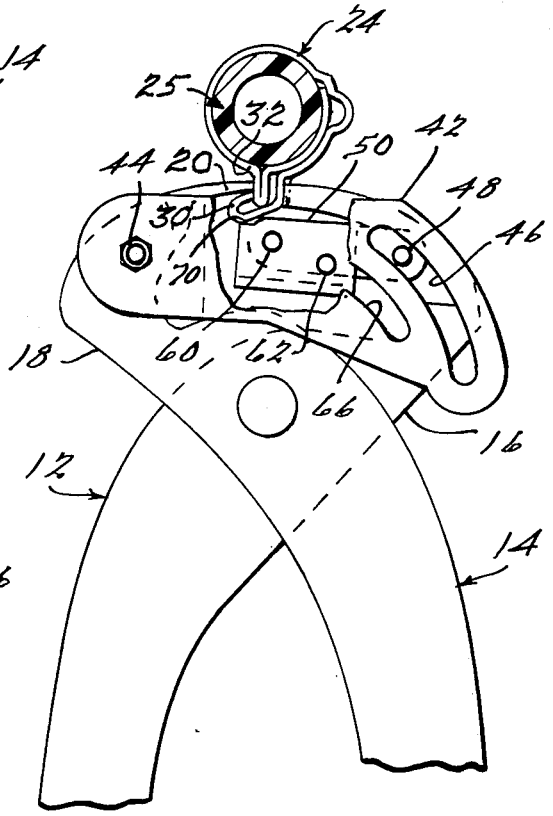
FIG. 4.
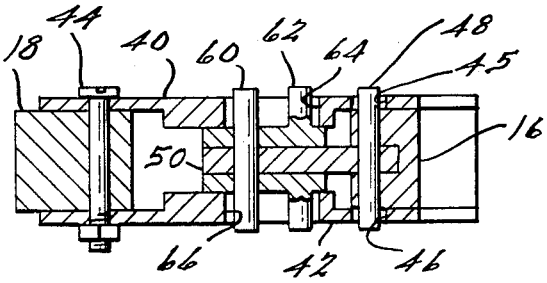
FIG. 5.

CAM ACTION TOOL FOR APPLYING A SPRING CLAMP

BACKGROUND OF THE INVENTION

Spring clamps that are openable to effect assembly about a hose are well taught in the prior art. Normally such clamps utilize a mechanical interlock in one form or another that requires a tool to effect closure thereof. However, known tools do not provide for positive clamp closure without a secondary operation.

SUMMARY OF THE INVENTION

A tool for applying a spring clamp in accordance with the present invention is of pliers configuration having opposed jaws which, in combination with a cam of unique configuration, effect positive closure of the clamp without requiring a secondary operation.

BRIEF DESCRIPTION OF THE DRAWINGS

FIG. 1 is an elevational view of a spring clamp in the open condition and disposed about a hose;

FIG. 2 is an elevational view of a tool in accordance with a constructed embodiment of the instant invention, in engagement with the spring clamp of FIG. 1;

FIG. 3 is a fragmentary view showing the jaws of the tool in engagement with the clamp and rotated to the partially closed condition;

FIG. 4 is a view showing the clamp in the fully closed condition with the cam thereof fully advanced; and FIG. 5 is a view taken along the line 5—5 of FIG. 2.

DETAILED DESCRIPTION OF THE PREFERRED EMBODIMENT OF THE INVENTION

As seen in FIG. 2, a preferred constructed embodiment of the instant invention comprises a tool 10 having handles 12 and 14 that are pivoted for relative rotation on a pin 15. The handles 12 and 14 have jaws 16 and 18 thereon, respectively.

The jaw 18 of the tool 10 has a relatively pointed end portion 20 for engagement behind a latch 22 of a spring clamp 24. As seen in FIGS. 1–4, the clamp 24 is disposed about a hose 25.

The opposite jaw 16 of the tool 10 has a relatively larger end portion 26 for engagement behind a latch hook 28 of the clamp 24.

As seen in FIG. 3 of the drawings, movement of the handles 12 and 14 toward one another effects movement of the jaw end portions 20 and 26 toward one another and biasing of the latch hook 28 over the latch 22. It is to be noted that, as seen in FIG. 4, the end portion 20 on the jaw 18 of the tool 10 is sufficiently narrow to be interposed between a reentrantly folded end portion 30 of the latch hook 28 and a portion 32 of the clamp 24 adjacent the latch 22 thereon.

As seen in FIGS. 2–5 of the drawings, the jaws 16 and 18 of the tool 10 are provided with a cam mechanism comprising a pair of side plates 40 and 42 that are pivotally supported on the jaw 18 by a pin 44. The side plates 40 and 42 have plate control tracks 45 and 46 therein, respectively, for acceptance of a pin 48. The pin 48 is fixed in the jaw 16 and extends through a cam block 50. The ends of the pin 48 extend into the tracks 45 and 46 in the side plates 40 and 42 to effect control thereof. The cam block 50 is pivoted for rotation relative to the jaw 16 by the pin 48. Thus, the pin 48 in combination with the tracks 45 and 46 both supports the cam 50 and controls the rotational position of the side plate 40 and 42 about the pin 44 thereof.

As best seen by comparing FIGS. 2, 3 and 4, rotation of the cam block 50 about the pin 48 is controlled by a pair of pins 60 and 62 that move in a pair of cam control tracks 64 and 66 in the side plates 40 and 42, respectively. As the jaws 16 and 18 move toward one another due to rotation of the handles 12 and 14 about the pin 15, the cam 50 is biased upwardly, as seen in the drawings, due to movement of the pins 60 and 62 in the tracks 64 and 66 in the side plates 40 and 42.

As best seen in FIG. 4 of the drawings, a concave portion 70 on the cam block 50 engages the radially outer portion of the reentrantly folded end 30 of the hook portion 28 of the clamp 24 to bias it upwardly to the fully closed condition.

From the foregoing description, it should be apparent that both closure of the clamp 24 and positive locking of the hook portion 28 thereof behind the latch 22 is accomplished by a single squeezing motion on the handles 12 and 14 of the tool 10. A discrete or separate movement of the tool is not required, total closure of the clamp 24 being affected by a single squeezing movement of an operator's hand.

From the foregoing description, it should be apparent that the tool of the instant invention is relatively simple in construction yet accomplishes positive assembly of a clamp about a hose with a minimum of effort.

While the preferred embodiment of the invention has been disclosed, it should be appreciated that the invention is susceptible of modification without departing from the scope of the following claims.

I claim:

1. In combination with an openable spring clamp of circular configuration and having a radially outwardly extending latch at one end and a latch hook at the other end, said latch hook having a radially outwardly extending portion, a circumferentially extending portion and a radially inwardly reentrantly folded portion, a tool for closing said spring clamp comprising:

a pair of handles, a pin joining said handles for relative rotation, a pair of jaws on said handles, respectively, one of said jaws being engageable with the latch on said clamp and the other of said jaws being engageable with the radially outwardly extending portion of the latch hook on said clamp, a cam pivotally supported by the other of said jaws, and means on said one jaw for controlling rotation of said cam, said cam being engageable with the hook portion of said clamp to effect closure of said clamp.

2. A tool in accordance with claim 1 wherein said cam has a concave section on a radially outer face thereof engageable with the circumferentially extending portion of the latch hook on said clamp thereby to cam said latch hook radially inwardly relative to said latch to effect closure of said spring clamp.

3. A tool in accordance with claim 1 wherein said means comprises a pair of plates pivotally supported by said one jaw on opposite sides thereof and having cam tracks therein, respectively, and a pair of pins on said cam acceptable in said cam control tracks to effect radially outwardly movement of said cam against the latch hook of said clamp.

4. A tool in accordance with claim 3 wherein said plates have a pair of plate control tracks therein, respectively, and a pin on said other jaw engaged in said plate control tracks.

* * * * *